United States Patent [19]

Comparetto et al.

[11] 4,441,499

[45] Apr. 10, 1984

[54] DYNAMIC ORTHOTIC PLATFORM

[76] Inventors: John E. Comparetto, P.O. Box 408, Chincoteague, Va. 23336; Paul R. Glaser, 8 Ford Pl., Dix Hills, N.Y. 11746

[21] Appl. No.: 147,675

[22] Filed: May 7, 1980

[51] Int. Cl.[3] ..... A61F 5/14

[52] U.S. Cl. ..... 128/595

[58] Field of Search ..... 128/25 B, 69, 80 D, 128/594, 595, 596, 80 R; 36/43, 76 R, 28, 44, 71, 91

[56] References Cited

U.S. PATENT DOCUMENTS

| | | | |
|---|---|---|---|
| 2,079,311 | 5/1937 | Blumenthal | 128/69 |
| 2,123,730 | 7/1938 | Huttleston | 128/594 |
| 3,121,430 | 2/1964 | O'Reilly | 128/594 |
| 3,469,576 | 9/1969 | Smith et al. | 128/595 |
| 3,845,507 | 11/1974 | Kirby et al. | 3/36 |
| 3,914,881 | 10/1975 | Striegel | 128/594 |
| 4,123,855 | 11/1978 | Thedford | 128/594 |
| 4,179,826 | 12/1979 | Davidson | 36/71 |

FOREIGN PATENT DOCUMENTS

| | | | |
|---|---|---|---|
| 200963 | 12/1958 | Austria | 128/594 |
| 1250059 | 11/1960 | France | 36/28 |
| 506875 | 12/1954 | Italy | 36/28 |
| 338266 | 11/1930 | United Kingdom | 128/594 |
| 454529 | 10/1936 | United Kingdom | 128/594 |

OTHER PUBLICATIONS

Webster's Seventh New Collegiate Dictionary G and C Merriam Co., Springfield, Mass. p. 802 "Shoe", 1963.

Webster's Seventh New Collegiate Dictionary, G & C Merriam Co., Springfield, Mass, 1963 p. 982 "Varus".

*Primary Examiner*—C. Fred Rosenbaum

*Assistant Examiner*—J. L. Kruter

*Attorney, Agent, or Firm*—James Creighton Wray

[57] ABSTRACT

A passive platform elongates under the pressures of ambulation directing fluid wave within a bag portion. The neutral subtalar joint position is attained by adjusting elastomeric assisting straps.

6 Claims, 17 Drawing Figures

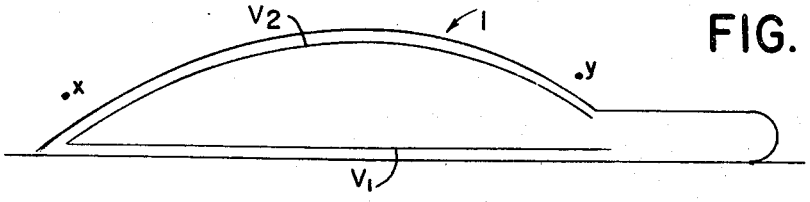
FIG. 1
FIG. 2
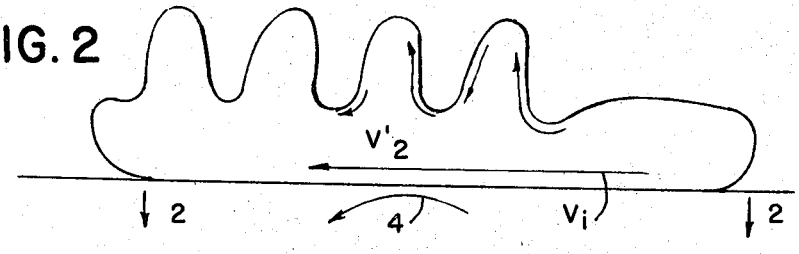
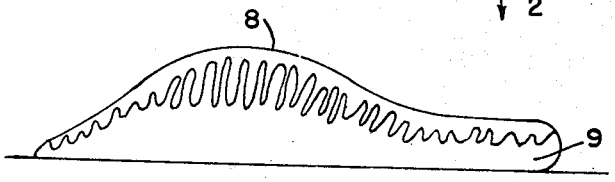
FIG. 3
FIG. 5
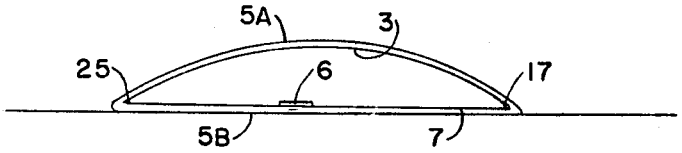
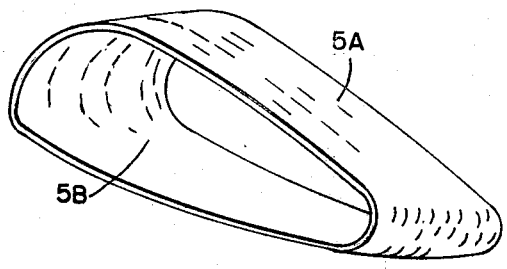
FIG. 4
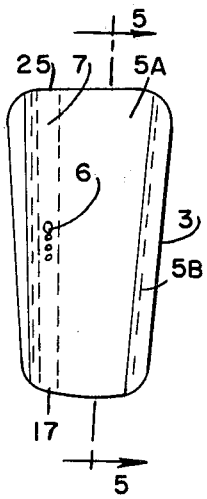
FIG. 6
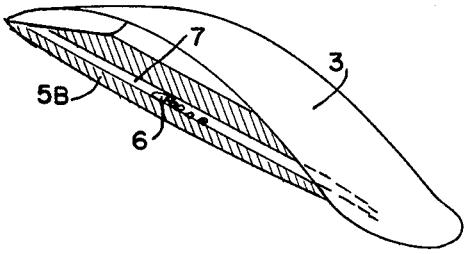
FIG. 7

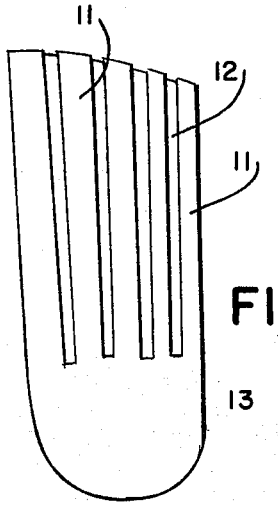
FIG. 8A
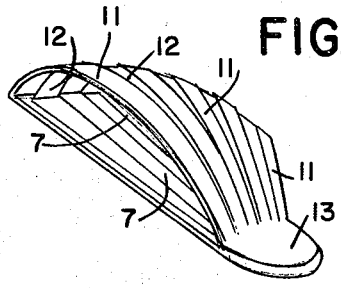
FIG. 8B
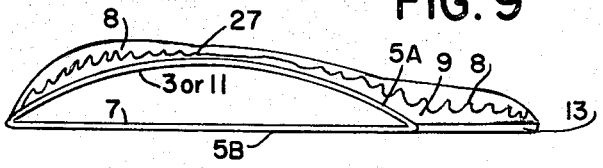
FIG. 9
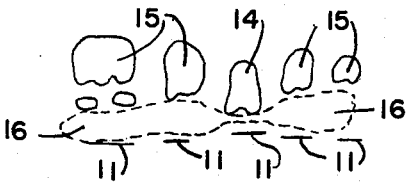
FIG. 10A
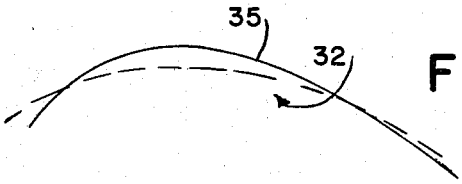
FIG. 10B
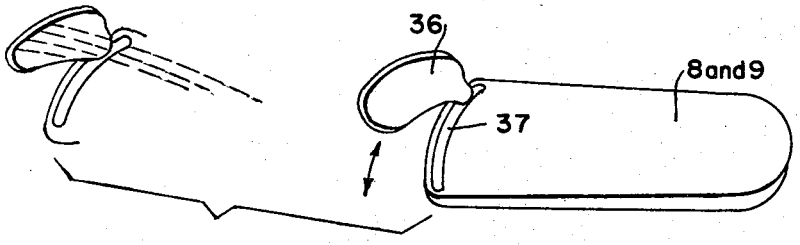
FIG. 11
FIG. 14B
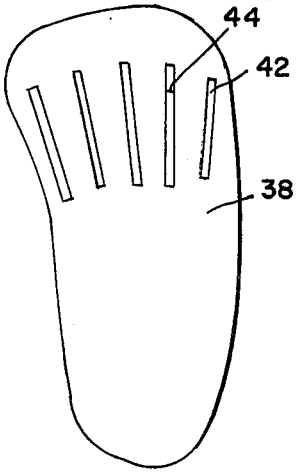
FIG. 12
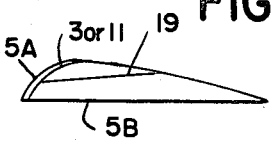
FIG. 13
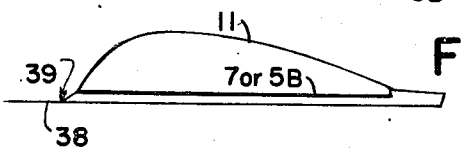
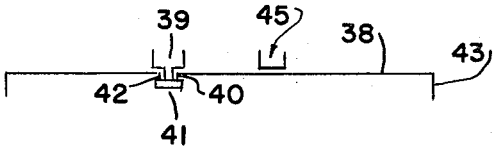
FIG. 14A

DYNAMIC ORTHOTIC PLATFORM

BACKGROUND OF THE INVENTION

The present invention relates to the use of a fluid wave to optimize biomechanical correction in the human foot. In addition, this invention allows for the adjustment of the patient to a neutral position by easy and practical means without the guide of a podiatric physician in easy, uncomplicated pathomechanical conditions. This apparatus will also allow the podiatric physician to help the patient obtain more efficient biomechanical alignment of the foot in gait in the more complicated pathomechanical conditions.

Presently, foot orthoses are made for controlling gait by controlling various forces during gait, thus giving a "more normal" alignment of bony structures. The orthoses are presently fabricated by pressing a malleable acrylic thermoplastic to a plaster impression of the patient's foot. This impression captures the foot in the neutral range of motion of the subtalar joint and the midtarsal joint locked in pronation. In addition, certain conditions warrant various cants to be applied to these orthoses relative to the cant of the patient's neutral subtalar position in relation to the leg.

The resultant orthoses yield a more optimum bony alignment of the feet for a normal gait. The orthotics are fabricated with various materials which control or limit motion from a greater to a lesser degree depending on the rigidity of the fabricant. Examples of these fabricants include Rohadur, plastizote, fiberglass, corex, cork, polyethylene, and others. While these orthoses are designed to achieve a certain degree of success by means of controlling body forces and gravity forces during gait, they fail to achieve any uniform success because they attack the problems of gait by limiting motion, thus forcing all feet into one categorical alignment to optimize gait efficiency. However, in so doing it also creates a static position of the foot despite the fact that the foot goes through various changes during gait.

The foot consists of twenty-eight (28) bones with thirty-eight (38) articulations and each bone and articulation a different size and shape in each individual. It is an astronomical task to commutate the probability of an exact force through any particular joint at any particular time during gait. It is, therefore, imperative to permit the bones of each foot to carry out its motion as determined by its morphology. However, recovery from this motion must be aided for maximal foot functioning gait.

OBJECTS OF THE INVENTION

An object of the invention is to provide a foot orthoses comprising a passive platform that will yield to the plantar surface of the foot during gait while being assisted beneath by dynamic bands of elastomeric material that will assist recovery and aid an individual's foot to reposition so that it will be in the proper alignment for the next phase of gait at the proper time.

Another object of the invention is to place bands of material of various tensile strength and recoil elasticity to assist recovery in a variable manner while attached to the undersurface of the passive platform.

Another object of the invention is to provide a compressible zone to enable the elongation of the passive platform prior to assistance during recovery.

Another object of the invention is to provide an adjustable mechanism for the changing of the tension on the assisting bands.

A further object of the invention is to use a passive platform that can be conformed to an impression of each patient's foot.

Another object of the invention is to provide for a series of passive platforms in a fan-like arrangement each supporting a foot ray.

Another object of the invention is to allow each individual passive platform corresponding to each individual foot ray to have an individual adjustable elastomeric assisting band.

A further object of the invention is to have a cambered fluid filled bag above and over the passive platforms.

A further object of the invention is to allow the passive platform to be adjusted by the assisting bands to impress and guide the cambered fluid filled bags in biomechanically advantageous ways.

Another object of the invention is to provide a glide plate upon which the distal ends of the passive platforms can slide easily for elongation.

A still further object of the invention is to allow for a guide slot, groove, or track along the glide plate to help direct the elongating passive platforms.

Upon further study of the specifications and appended claims, further objects and advantages of this invention will become apparent to those skilled in the art.

BRIEF DESCRIPTION OF THE DRAWINGS

FIG. 1 is a longitudinal section of a cambered fluid-filled bag.

FIG. 2 is a longitudinal section of a camber-like fluid-filled bag having ridges.

FIG. 3 is an example of a cambered fluid-filled bag having an internal ridge cambered bag.

FIG. 4 is a perspective view of the primary elastomeric recovery strap.

FIG. 5 is a longitudinal cross section view along the lines 5—5 of FIG. 6 of a passive platform primary and secondary recovery straps.

FIG. 6 is a planar view from above of the passive platform, the primary recovery strap, and the auxiliary assisting strap for a first ray.

FIG. 7 is a perspective view of FIG. 6.

FIG. 8A is a view from above of the fanning arrangement of individual passive platforms.

FIG. 8B is a perspective-rearward view of the fanning arrangement of passive platforms with the auxiliary assisting straps.

FIG. 9 is a longitudinal view of the passive platform primary and auxiliary assisting straps and fluidic bag compartment.

FIG. 10A is a cross-sectional view showing the effect of individual passive platforms deployment in conjunction with fluid wave deployment for metatarsal head lesions.

FIG. 10B is a longitudinal view of passive segments of varying amplitude.

FIG. 11 is an adjustable fluidic compartment for the forefoot.

FIG. 12 depicts an elastomeric band of less length than the primary assisting strap.

FIG. 13 shows a longitudinal view of the glide plate.

FIG. 14A shows a cross-sectional view of a glide plate shouldered from shoe material.

FIG. 14B shows glide plate from above depicting glide tracks.

DETAILED DESCRIPTION OF THE INVENTION

FIG. 1 shows how fluid particles from Area Y under equal force will take longer to travel to Area X on Path V2 than on Path V1 much like air travels over the wing of a plane.

FIG. 2 shows a rigid arrangement increasing the differential of fluid particle travel between V1 and V2 causing the entire fluidic bag 1 to buckle upward as indicated by Arrows 2 and 4.

In FIG. 3 we see a fluidic bag arrangement of a camber shape having an internal fluid bag arrangement with an upper ridged portion following the contours of the camber. The fluid wave of these bag-like arrangements are utilized to place a directional wave force to specific areas of the foot during gait. In this application the fluid waves are, in turn, guided by a series of passive platforms and elastomeric recovery straps.

In FIG. 5 we see a lateral or longitudinal view of a passive platform 3, wrapped by a primary assisting strap 5A and B seen in perspective view in FIG. 4 and an internal auxiliary adjustable assisting strap 7. Adjustment band 6 can be a clip, snap, buckle, or other fastening means to increase or decrease tension on elastomeric strap 7.

FIG. 6 is a view from above of the passive platform 3, the primary assisting strap 5A and B, and an example of an adjustable auxiliary assisting strap 7 that in this instance can be made to increase the amplitude of passive platform 3 beneath the first ray of the foot. The first ray of the foot herein is considered the first metatarsal medial cuneiform as well as the most medial and distal side of the navicular. In using adjustment 6 of auxiliary assisting strap 7, pressure is placed on ends of passive platform at areas 17 and 25 while in the weight bearing stance phase. The heel has been manipulated to the neutral weight bearing position by supinating or pronating the forefoot manually. In this stance phase, the neutral subtalar position is considered when the calcaneous is in straight alignment with the lower portion of the leg. This can now be readily accomplished by the individual by adjusting the medial most auxiliary assisting strap until a straight calcaneous to leg alignment is accomplished.

In FIGS. 8A and 8B, the passive platforms have been split and fanned to correspond to each foot ray from the first to the fifth metatarsal. The relative lengths above the passive platforms for each ray as well as the elastomeric assisting straps would comply to a normal transverse parabola of the metatarsal heads.

In FIG. 8A, the passive platform segments 11 are connected by fabric or some other suitable material 12.

In FIG. 8B, a view from the posterior of the orthotic displays the fanning of segments 11 as well as the relative heights of these segments being high under the first metatarsal to lowest under the fifth metatarsal. This maximum height is attained by adjusting the elastomeric assisting strap 7 to allow the passive segments to conform to the longitudinal foot arch while the patient stands with the foot in the neutral subtalar position as discussed earlier. The passive segments 11 can become confluent at the heel seat 13 being cut from the same material, for example, polyethylene. The segments 11 can be laminated to the heel seat area 13 or otherwise separately attached to heel seat 13.

In FIG. 9 is seen a posterior and anterior compartmentalized cambered fluid-filled bags 8, each having an internal ridge cambered bag 9. The anterior and posterior bags are connected by a narrow isthmus 27. At heel contact, the rearward fluid bag compresses and cushions the foot sending a fluid wave towards isthmus 27. Passive platform 3 or passive platform segments 11 flex downward as the weight is transferred anteriorly. This downward motion of platforms 3 or 11 begin soon after heel contact allowing isthmus 27 to widen in its vertical dimension accommodating the on-rushing fluid wave. At the midstance phase of the closed kinetic chain of gait, the isthmus 27 is obliterated by the persons weight leaving some fluid in the rearward compartment but most fluid in the forward compartment. As the weight rolls through the midfoot onto the metatarsal heads, a fluid wave is propagated into these regions as described in the inital application, being directed toward a varus or valgus discrepancy in the forefoot as determined by maximum pronation against the ground surfaces. At toe off, the fluid sacs as well as the passive platforms, recover their non-weight bearing shapes.

The medial section 11 would approximate the bisection of the first metatarsal shaft ending just behind the first metatarsal head. The segments corresponding to the second, third, and fourth, metatarsals would approximate the area directly beneath the metatarsal shafts of each of these three bones, again ending just behind the metatarsal head at about the surgical neck region. The lateral most segment 11 would be beneath the fifth metatarsal head or the bisection of the fifth metatarsal head. The sizing of segments 11 would be adequate ending anywhere within the distal most one third of the metatarsal heads. The lateral and medial most extent of the lateral and medial segments could include the entire first and fifth metatarsal shafts or be as narrow as to bisect the metatarsal shaft. It can be seen with this variance of dimensions several number of foot sizes would correspond to an orthotic number. If a limited size range was desirable, a large range of sizes could also be made available. In either case, dynamic function of the orthotic and its ability to put the foot into the neutral position by adjustment, would not be diminished.

FIG. 10A is a cross-section of metatarsal heads. In this example, the third metatarsal head 14 is seen to be lower than the other four metatarsals 15. The assisting elastomeric strap corresponding to the third metatarsal head would be tightened to raise this segment 11 to a position in amplitude slightly higher than the other four. Upon the transference of weight across the passive platforms, the segment 11 of the third metatarsal, in this case, would thrust anteriorally and upward away from the other four segments. The strength of upward thrust on this segment would also be greater than the upward recover of the other four passive segments due to the greater tension placed on the elastomeric assisting band. The increase in amplitude of this passive segment 11 would cause the depressed third metatarsal 14 to thrust upward, simultaneously impressing the cambered fluid-filled bag to constrict fluid away from the distribution of the third's metatarsal shaft flowing medially and laterally in two separate boluses of fluid wave, dotted area 16. This distribution of the fluid wave causes metatarsal heads 15 to take the weight rather than the third metatarsal head with its uncomfortable and painful plantar lesion. It will be noted in FIG. 10B that all of the passive segments, while thrusting downward on weight bearing, will also tend to wave in an anterior or distal direction. Passive platform curve 32 would represent such a wave for the four passive segments corresponding to the first, second, fourth, and fifth metatarsals of the above example. Curve 35 would represent the anteriorally or distally directed passive platform wave of a higher amplitude, due to the greater stretch on its corresponding elastomeric assisting strap, beneath the third metatarsal 14. The tendency to wave is enhanced by the fluid wave thrust 4 in FIG. 2. In certain foot conditions, it may be desirable to exert short passive curve pressures wherein the assisting elastomeric band 19 is shorter than the primary band 5A and B as seen in FIG. 12.

In FIG. 11 an adjustable fluidic compartment 36 is seen as a movable extension of the primary fluidic area. This forefoot compartment 36 moves within slot 37 to either accommodate a varus or valgus problem. This compartment may be an accessory part of the orthotic for placing fluid waves under a forefoot valgus or varus deformity. In most instances, the forefoot valgus positioning will be treated by raising the amplitude of the first and second segments 11 causing a fluid wave of the primary fluidic compartment 8 and 9 to move laterally supporting metatarsals three through five. In the forefoot valgus condition, complicated by a rigid plantar flexed first ray, softer support medially is desired. This is accomplished by raising the height of the lateral three segments while allowing the fluid wave to pass medially under the head of the first metatarsal. This would give a shallow lateral cushion with a firmer underbase of the three most lateral segments while the first and second metatarsals would benefit from a more easily compressible deeper fluid wave. Since the amplitude of segments 11 can be adjusted to form a structural ribbed varus or valgus post, most instances of treating these deformities would be accomplished with a relatively even dispersal of the fluid wave. The auxiliary distal fluidic bag compartment 36 can be made smaller to act as a buttress pad for contracted and deformed digits.

Elongation of the passive platforms can be controlled by tension on and thickness of the elastic bands. In order to guard against the end of the passive platform segments 11 digging into shoe material at ends 39, glide platform 38 is provided (FIG. 13). The glide platform provides a smooth hard surface to allow for efficient forward extension of the passive platform as desired. The glide platform 38 can be a separate piece that fits into the shoe separately as an inner sole over the shoe material or is physically a continuation of the heel region of the orthotic apparatus.

The glide plate may have tracks 45 as depicted in FIG. 14A or pass through a slot 42 having shoulder 39 slide on platform 38 while held in place by top 41 and neck 40. Shoulder 43 would be needed for the slot arrangement to provide room for movement of the neck 40 and top 41 of the end 39 without hitting the shoe material.

FIG. 14B shows 42 as either a track on upper surface of 38, a slot through 38, or a groove within 38.

The tracks, slots, or grooves would provide guidance of the elongating arms to go into specific anatomical areas for various biomechanical conditions. Section 44 depicts a block within the groove, slot, or track, to prevent a specific passive platform from elongating as far as the other passive platforms.

From the foregoing description, one skilled in the art can easily ascertain the essential characteristics of this invention and without departing from the spirit and scope thereof can make various changes and modifications of the invention to adopt to its various biomechanical, orthopedic, and sport usages and conditions.

What is claimed:

1. An orthotic platform apparatus to optimize biomechanical correction of the human foot comprising:

upper element means forming a passive platform segment means with end and medial portions, lower element strap means with end and medial portions, said passive platform means extending from one end and longitudinally forming fan-like continuous ray members to correspond to first through fifth metatarsal bones of the human foot, passive platform segment means for each ray to support the human foot, elastomeric assisting strap means to comply with normal transverse parabola at metatarsal heads of the human foot, passive platform segment means secured to one another, elastomeric adjustable strap means to increase amplitude at the passive platform segment means to conform to foot arch while a human is in standing position, adjustable strap means being secured to the passive platform means at an end portion to form a heel seat.

2. Orthotic platform apparatus for biomechanical correction of a human foot comprising:

upper element means for underlying a human foot, lower element means connected to the upper element means for holding the upper element means in desired conformation, the upper element means further comprising passive platform segment means, which are split and fanned to correspond to each foot ray from first to fifth metatarsal bones, thereby defining individual passive platform segment means for each foot ray, the lower element means comprising elastomeric strap means connected to the passive platform segment means for tending to increase the amplitude of the passive platform segment means to conform to a foot arch while a human is in standing position wherein the strap means are adjustable in length to selectively adjust height of respective platform segment means.

3. The orthotic platform apparatus of claim 2 wherein the passive platform segment means are confluent at a rearward end of the upper element to form a heel seat.

4. The orthotic platform apparatus of claim 2 wherein the passive platform segment means are laminated to a heel seat at a rearward end portion of the upper element.

5. Orthotic platform apparatus for biomechanical correction of the human foot comprising:

upper element means for underlying and supporting a human foot, the upper element means having forward and rearward ends and a medial portion between the forward and rearward ends, elastomeric assisting means connected to the upper element means and extending from the forward to the rearward ends thereof for tending to increase the amplitude of the upper element means at a medial portion thereof to conform to a foot arch when a human is in standing position position wherein the upper element means is longitudinally divided in the medial portion between the forward and rearward ends into fan-like continuous ray members for corresponding to and for individually supporting first through fifth metatarsal bones of a human foot, and wherein the elastomeric assisting means is divided into individual elastomeric strap means connected to respective continuous ray members for tending to increase amplitude of respective continuous ray members to conform to the foot arch and metatarsal bone positions while a patient is in standing position.

6. The orthotic platform apparatus of claim 5 wherein the elastomeric strap means are individually adjustable to respectively individually adjust amplitude of the continuous ray members to conform to desired positions of metatarsal bones in a human foot arch.

* * * * *